US007691227B2

(12) United States Patent
Riou

(10) Patent No.: US 7,691,227 B2
(45) Date of Patent: Apr. 6, 2010

(54) BLEACHED, MECHANICAL PAPER PULP AND THE PRODUCTION METHOD THEREFOR

(75) Inventor: Claude Raymond Riou, Menthon St. Bernard (FR)

(73) Assignee: International Paper Company, Memphis, TN (US)

( * ) Notice: Subject to any disclaimer, the term of this patent is extended or adjusted under 35 U.S.C. 154(b) by 0 days.

(21) Appl. No.: 12/401,069

(22) Filed: Mar. 10, 2009

(65) Prior Publication Data

US 2009/0229772 A1 Sep. 17, 2009

Related U.S. Application Data

(62) Division of application No. 10/494,380, filed as application No. PCT/FR02/03691 on Oct. 28, 2002, now Pat. No. 7,501,041.

(30) Foreign Application Priority Data

Oct. 30, 2001 (FR) ..... 01 14010

(51) Int. Cl.
*D21C 9/00* (2006.01)

(52) U.S. Cl. ..... 162/9; 162/142; 162/181.2; 162/72; 162/158; 428/372; 428/220

(58) Field of Classification Search ..... 162/9, 162/142, 181.2, 72, 158; 428/372, 220
See application file for complete search history.

(56) References Cited

U.S. PATENT DOCUMENTS

| | | | |
|---|---|---|---|
| 5,080,754 | A | 1/1992 | Francis et al. |
| 5,679,220 | A | 10/1997 | Matthew et al. |
| 5,731,080 | A | 3/1998 | Cousin et al. |
| 6,387,212 | B1 | 5/2002 | Christian |
| 6,706,148 | B1 | 3/2004 | Joisson et al. |
| 2005/0045288 | A1 | 3/2005 | Riou |

FOREIGN PATENT DOCUMENTS

| | | |
|---|---|---|
| EP | 1076132 | 2/2001 |
| FR | 2689530 | 10/1993 |
| FR | 2775301 | 8/1999 |

*Primary Examiner*—Mark Halpern
(74) *Attorney, Agent, or Firm*—Thomas W. Banres, III

(57) ABSTRACT

This invention relates to bleached mechanical paper pulps, based on fibrillated fibers of cellulose, hemicelluloses and lignin, containing calcium carbonate, in which calcium carbonate is crystallized and at least partly covers the fibrillated fibers of cellulose, hemicelluloses and lignin to which the calcium carbonate is mechanically bonded, papers made from these pulps and their preparation process.

19 Claims, 13 Drawing Sheets

BLEACHED, MECHANICAL PAPER PULP AND THE PRODUCTION METHOD THEREFOR

Figure 1:
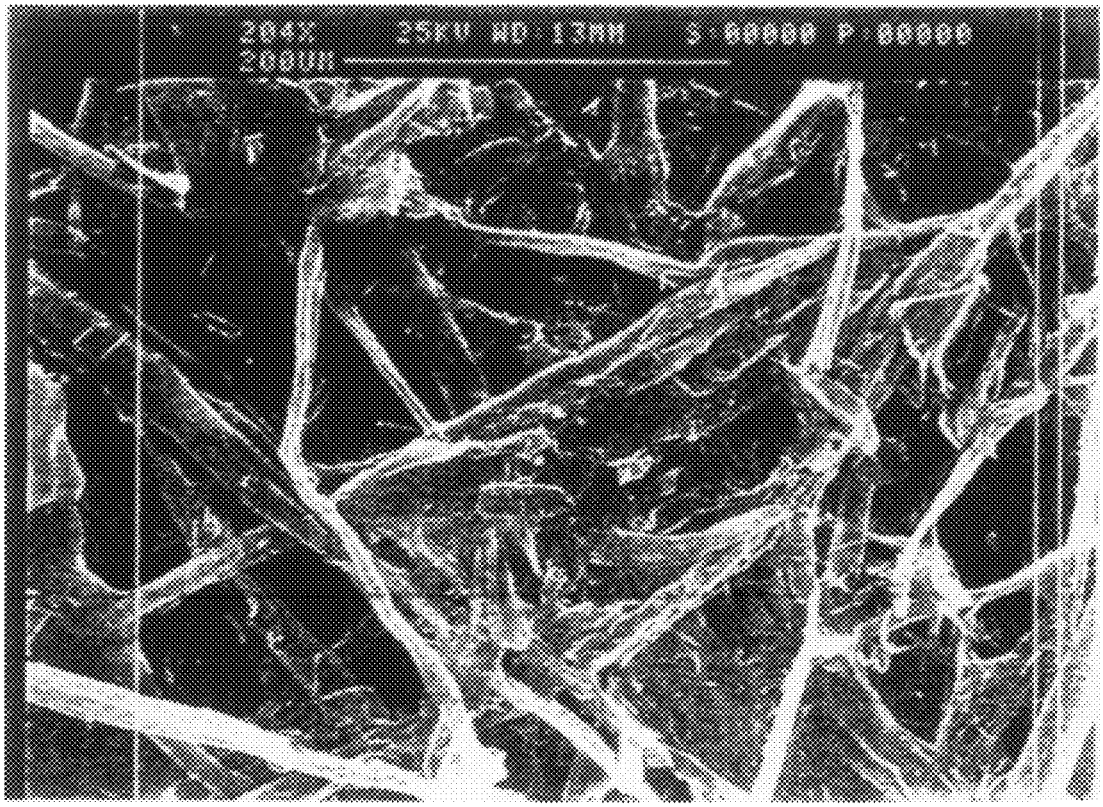

This invention relates to the technical domain of paper-making, and more particularly to paper and paper pulp. In particular, the purpose of this invention is a new bleached mechanical paper pulp, a process for manufacturing it, and the paper obtained from such a pulp.

Pulp derived from wood used in making paper may be either mechanical pulp or chemical pulp.

Mechanical pulp obtained directly from debarked logs or sawmill waste or cutting waste, contains all constituents that were present in the original wood and particularly cellulose, hemicelluloses and lignin.

Mechanical pulp means pulp produced from wood, using a grinding and/or refining type mechanical process, this process possibly being accompanied by chemical, physical or heat treatments, either separately or simultaneously, one of the characteristics of these types of pulp being that they contain most of the lignin originally present in the wood.

A preliminary chemical treatment is often carried out before grinding. For example, wood chips can be impregnated with oxygenated water, combined with caustic soda (the APMP "Alkaline Peroxide Mechanical Pulp" process) or with sodium sulphite (the CTMP "Chemo Thermo Mechanical Pulp" process). This type of chemical treatment opens up the compact structure of fibres and reduces energy consumption during the grinding step.

As a result of the grinding and refining used in the production of mechanical pulp, the SCHOPPER RIEGLER(SR) wetness value of this pulp is usually more than 22.

Furthermore, the refining process used generates a large fibre size distribution due to tearing and delamination that takes place along the fibre walls, and fibre cutting phenomena. Fibre fragments, fibrils and fibrillated fibres are responsible for BCTMP ("Bleached Chemi Thermo Mechanical Pulp") having a much higher specific area than chemical pulp (E. Cannell and R. Cockram, PPI, May 2000, p 51-61).

Chemical pulp is produced using processes that tend to separate cellulose fibres with minimum degradation. The principle is to eliminate most of the lignin and some of the hemicelluloses bonded to the lignin by dilution in an aqueous medium containing appropriate reagents, for example:

Process with sulphite acid: $H_2SO_3(SO_2)/NaHSO_3$,

Process with neutral sulphite: $Na_2SO_3(NaHSO_3)/NaHCO_3(Na_2CO_3)$,

Process with sulphate (Kraft): NaOH, $Na_2S(NaHS)/Na_2CO_3$,

Process with soda: $NaOH/Na_2CO_3$.

In particular, for the manufacture of white paper, it is often necessary to bleach chemical or mechanical pulp. This bleaching is obtained using chemical products in which the role is either to dissolve and extract part of the lignin, or to discolour it. These chemical products include chlorine dioxide, hydrogen peroxide and ozone for chemical pulps, and hydrogen peroxide for mechanical pulps. The residual lignin content in bleached mechanical pulps is much higher than the content in bleached chemical pulps, since most of the lignin remains in the fibres (E. Cannell and R. Cockram, PPI, May 2000, p 51-61).

These paper pulps are used for the production of paper that may be subjected to special treatments during production to give it special characteristics. For example, the addition of mineral fillers such as kaolin, titanium oxide, talc, calcium carbonate, improve printability, opaqueness and dimensional stability of paper.

Mechanical pulps have the following particular advantages over chemical pulps (E. Cannell and R. Cockram, PPI, May 2000, p 51-61):

- a lower investment cost,
- efficient use of wood (85 to 95% compared with 42 to 52% for chemical pulps), and consequently they are obtained at lower cost,
- an improvement of some physical properties of papers obtained with these pulps, such as bulk, opaqueness and stiffness,
- a lower environmental impact caused by waste.

However, one of the major obstacles to the use of mechanical pulps is their tendency to yellowing under light. It is generally accepted that the main photochemical reactivity is due to the high content of lignin in mechanical pulps. Lignin tends to oxidise into coloured products. BCTMP (Bleached Chemi Thermo Mechanical Pulp) pulps, for example, are used mainly for the production of paper with low added value and short life, due to the fact that they turn yellow under light (Nordic Pulp and Paper Research Journal, 1998, 13(3), 198-205).

Thus, future commercial applications of mechanical pulps depend largely on the development of new economic technologies to improve the stability of these mechanical pulps to light, and thus to limit their yellowing. For example, protective agents such as UV absorbers and antioxidising agents may be used on the paper surface to limit yellowing of paper made from mechanical pulps. These additives, the most efficient of which are derivatives of benzophenone, benzotriazole, and diamino stilbene, will delay yellowing under light, but do not completely solve this problem (C. Li and A. J. Ragauskas, Journal of Pulp and Paper Science, Vol. 27, No. 6, June 2001, p 202), (S. Bourgoing, E. Leclerc, P. Martin and S. Robert, Journal of Pulp and Paper Science, Vol. 27, No. 7, July 2001, p 240).

Furthermore, these additives have a high cost and a negative effect on the opaqueness and colour of papers. Moreover, these additives degrade with time, leading to a gradual loss of efficiency in time.

Another approach that was considered to solve this problem of yellowing of mechanical pulps under light, consisted of depositing at least 5 $g/m^2$ of a pigmented composition on each side of the paper, containing at least 10% of rutile structured titanium oxide (R. W. Johnson, Tappi Journal, May 1991, 209). Once again, this proposed solution was not widely developed industrially due to its limitations related to the high cost of titanium oxide, application limited to paper machines with an appropriate coating tool and by the fact that it only provides a solution limited to the production of coated papers, and therefore cannot be used to make uncoated papers.

Therefore, there seems to be a need for new techniques for supplying bleached mechanical paper pulps with improved stability to light.

Another objective of this invention is to obtain a simple, economic and industrial paper pulp with limited yellowing under light.

Within this context, the purpose of this invention is a bleached mechanical paper pulp based on fibrillated fibres of cellulose, hemicelluloses and lignin containing calcium carbonate, characterised in that calcium carbonate is crystallised and at least partly covers the fibrillated fibres of cellulose, hemicelluloses and lignin to which the calcium carbonate is mechanically bonded.

It has been demonstrated that when the fibrillated fibres of cellulose, hemicelluloses and lignin are at least partly covered by crystallised calcium carbonate, stability of the resulting paper pulp to light is improved. One explanation could be that this coverage protects the lignin from light by the grains of calcium carbonate, which would limit this oxidation, which causes yellowing of the paper pulp and the papers obtained.

Another purpose of the invention is to provide a new process for improving the stability of bleached mechanical pulps to light.

Another purpose of this invention is a process for manufacturing paper pulp according to the invention comprising the following steps:

a) formation of a homogenous aqueous slurry by mixing previously bleached mechanical paper pulp based on fibrillated fibres of cellulose, hemicelluloses and lignin in an aqueous medium with a Schopper Rieggler value equal to at least 22°, and lime, b) if the content of dry materials in the slurry obtained in step a) is greater than 10% by weight, dilution of the said slurry until the slurry obtained contains a ratio of dry material less than 10% by weight, and preferably less than 5% by weight, c) addition of carbon dioxide by injection into the said slurry while mixing the said slurry and keeping its temperature between 10 and 50° C., until complete transformation of the lime into calcium carbonate that crystallises in situ.

Various other characteristics of the invention will become clear after reading the description given below with reference to the attached drawings.

Figure 2:
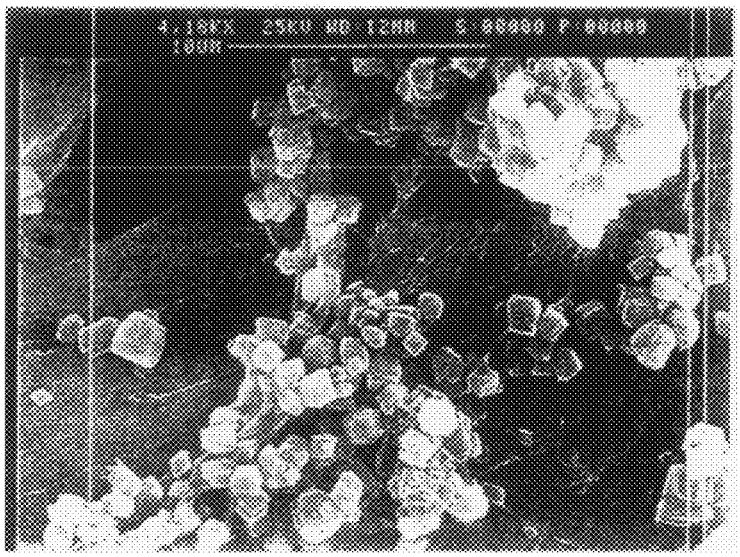
Figure 3:
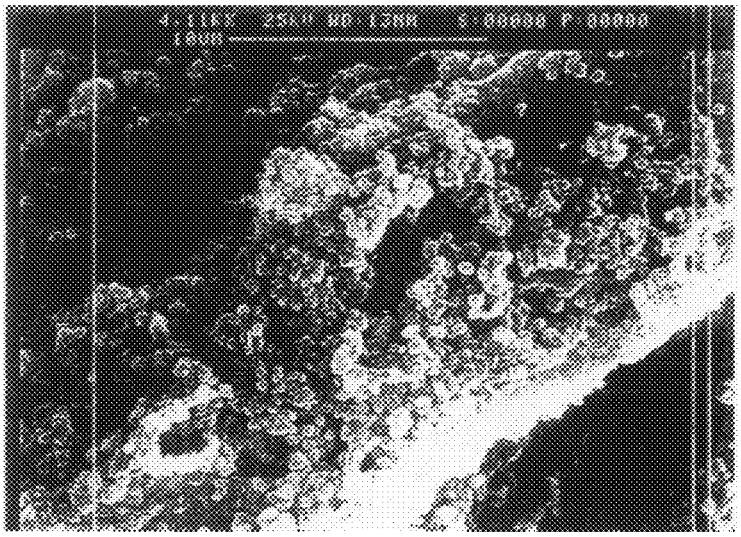
Figure 4:
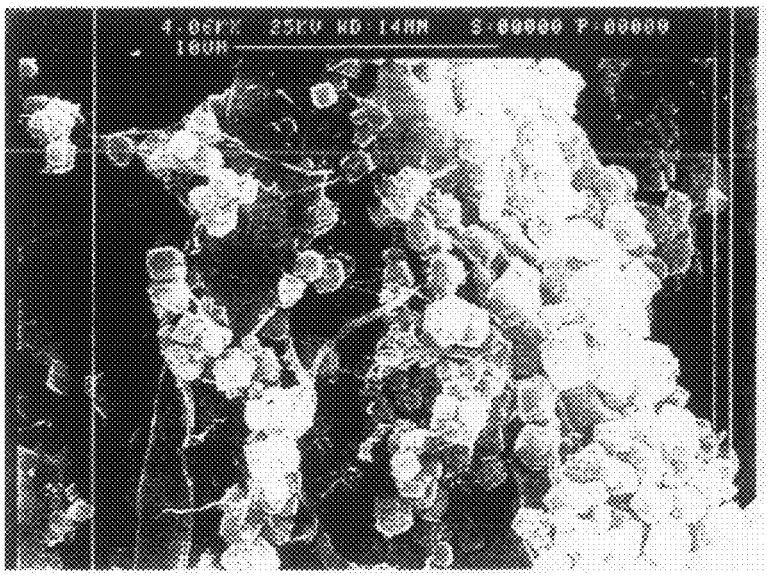
Figure 5:
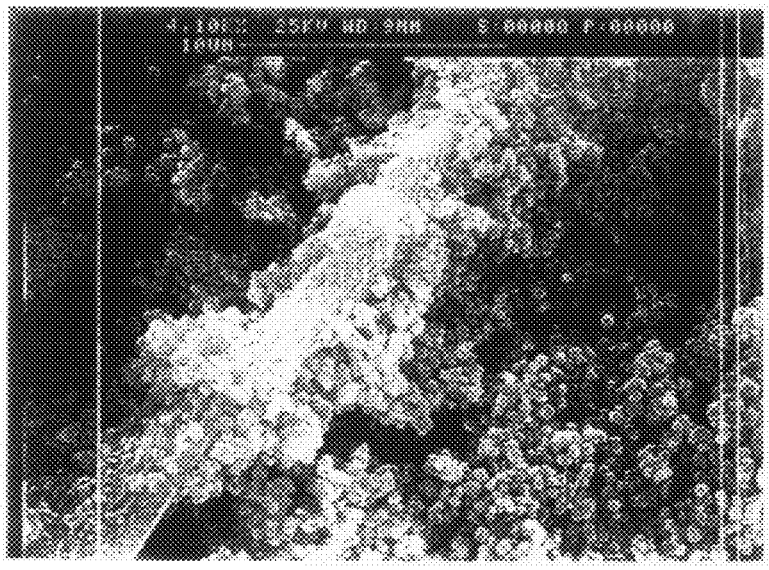
Figure 6:
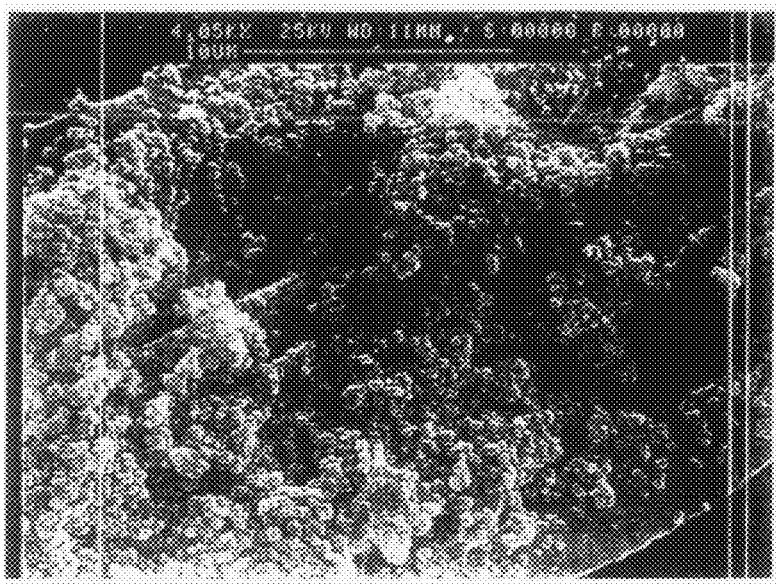
Figure 7:
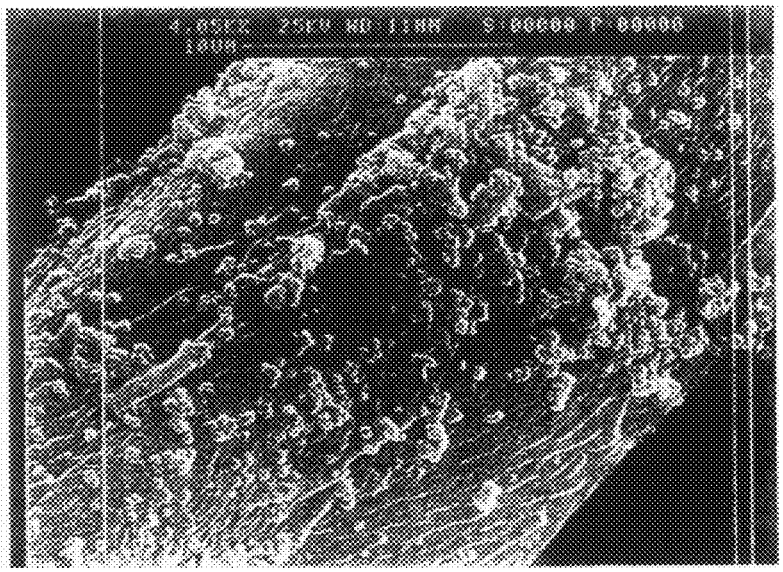
Figure 8:
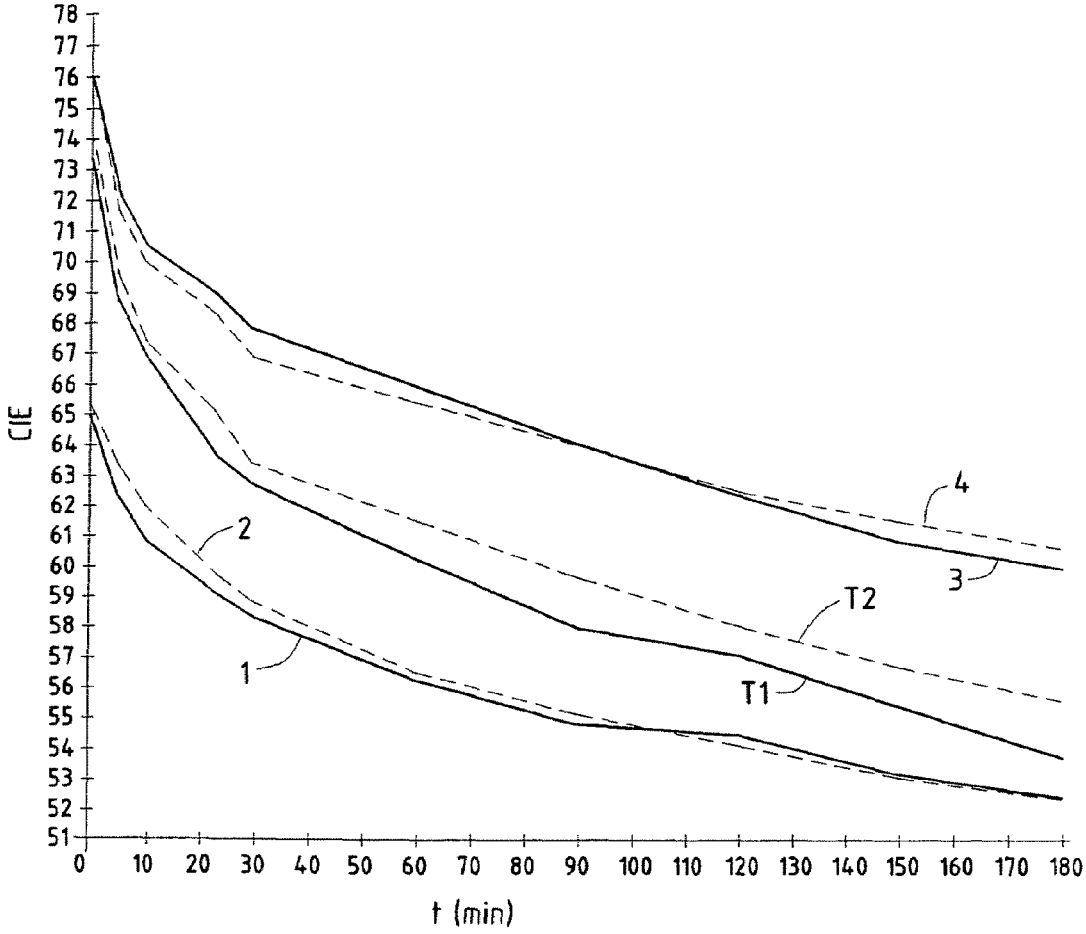
Figure 9:
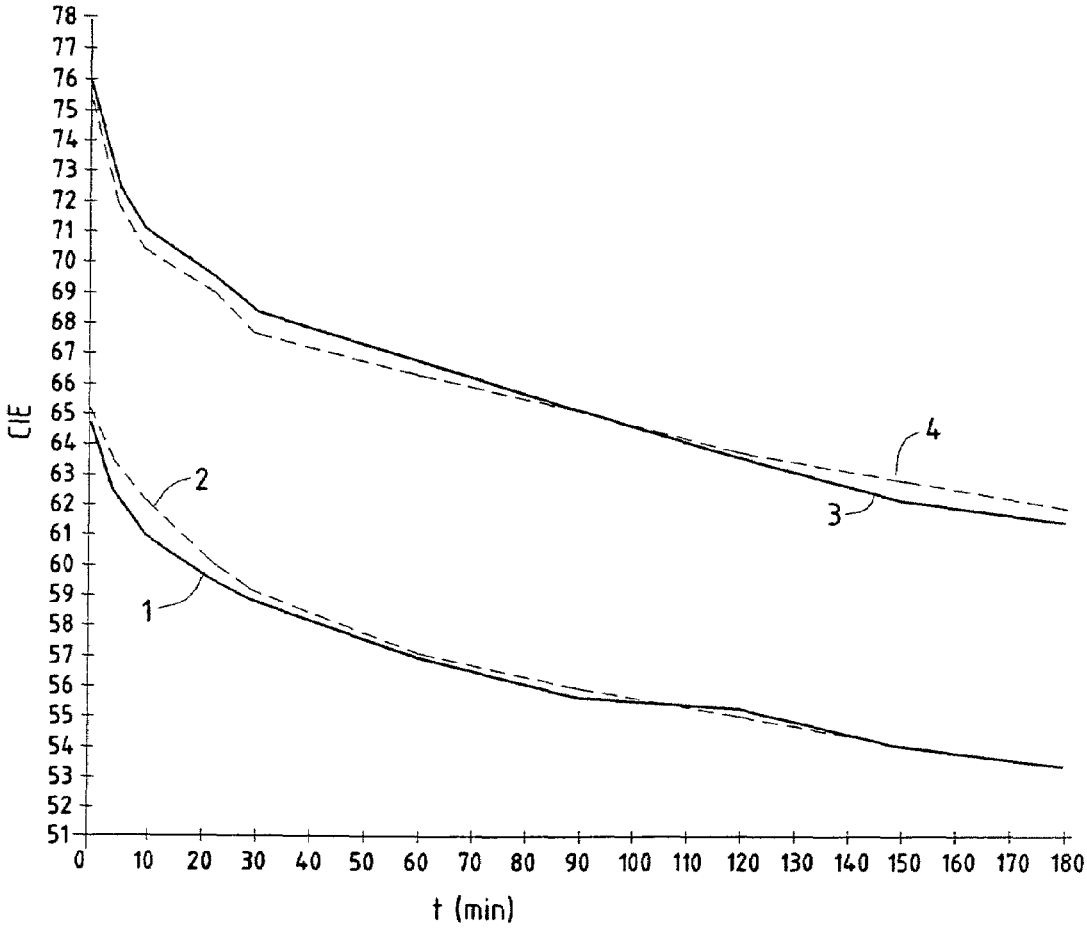
Figure 10:
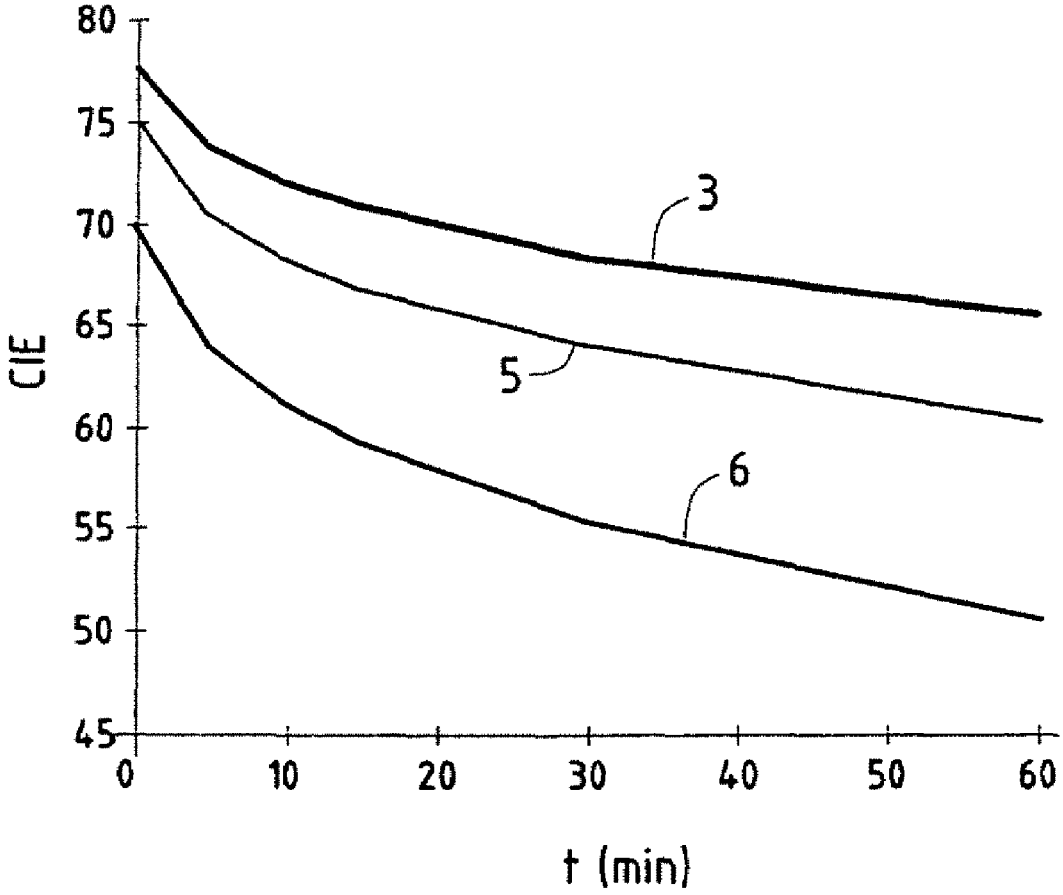

FIG. 1 to 7 are views taken with a scanning electronic microscope (SEM) of different paper pulps:

FIG. 1 is a view with a magnification of 204 times, showing a paper pulp obtained with BCTMP RANGER SLAVE LAKE PULP CORPORATION R250B85 at 52° SR, FIG. 2 is a view with a magnification of 4,180 times, showing a paper pulp according to the invention obtained with 30% of BCTMP RANGER SLAVE LAKE PULP CORPORATION R250B85 at 38° SR and 70% of $CaCO_3$ obtained from unground slaked lime, FIG. 3 is a view with a magnification of 4,110 times, showing a paper pulp according to the invention obtained with 30% of BCTMP RANGER SLAVE LAKE PULP CORPORATION R250B85 at 38° SR and 70% de $CaCO_3$ obtained from ground slaked lime, FIG. 4 is a view with a magnification of 4,060 times showing a paper pulp according to the invention obtained with 30% of BCTMP RANGER SLAVE LAKE PULP CORPORATION R250B85 at 52° SR and 70% of $CaCO_3$ obtained from unground slaked lime, FIG. 5 is a view with a magnification of 4,100 times of a paper pulp according to the invention obtained with 30% of BCTMP RANGER SLAVE LAKE PULP CORPORATION R250B85 at 52° SR and 70% of $CaCO_3$ obtained from ground slaked lime, FIG. 6 is a view with a magnification of 4,050 times of a paper pulp according to the invention obtained with 50% of BCTMP RANGER SLAVE LAKE PULP CORPORATION R250B85 at 38° SR and 50% of $CaCO_3$ obtained from ground slaked lime, FIG. 7 is a view with a magnification of 4,050 times of a paper pulp according to the invention obtained with 70% of BCTMP RANGER SLAVE LAKE PULP CORPORATION R250B85 at 38° SR and 30% of $CaCO_3$ obtained from ground slaked lime, FIG. 8 to 10 show the variation of the whiteness (CIE) of different types of paper pulps according to the invention as a function of the exposure time, obtained using an accelerated test:

FIG. 8 demonstrates the limited yellowing of paper pulps according to the invention, FIG. 9 shows the influence of grinding of the lime used, FIG. 10 demonstrates the influence of the content of the calcium carbonate.

Figure 11:
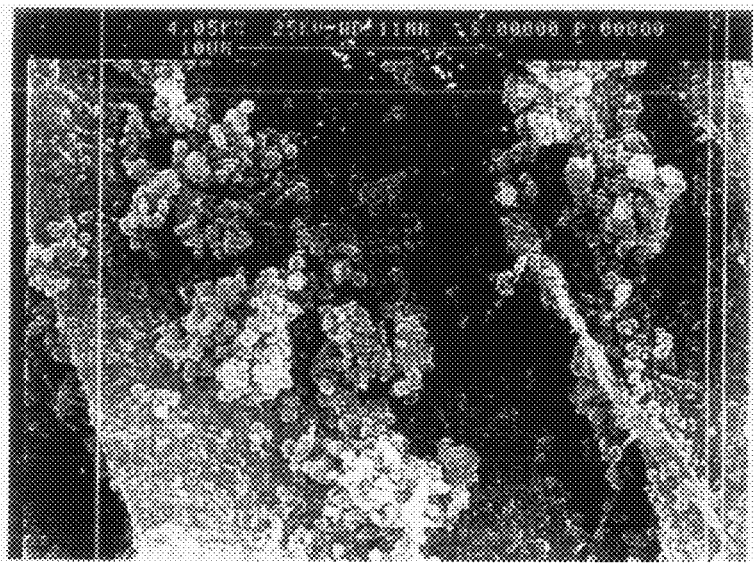
Figure 12:
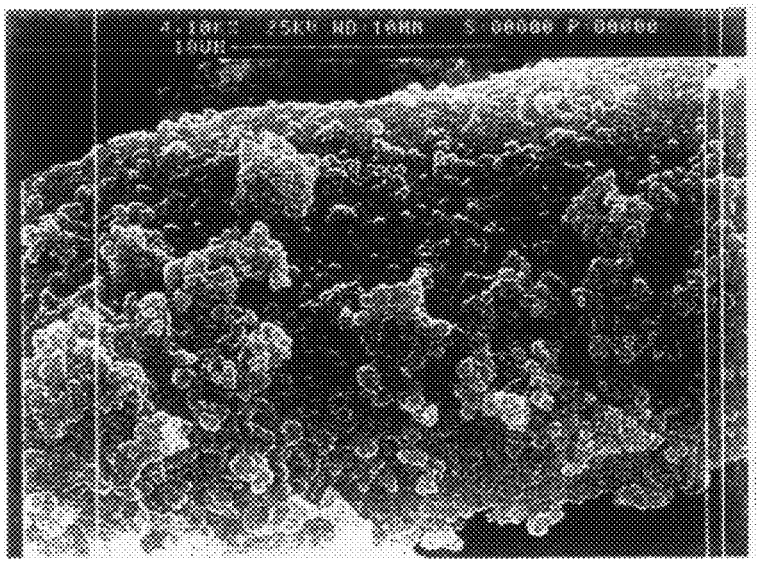
Figure 13:
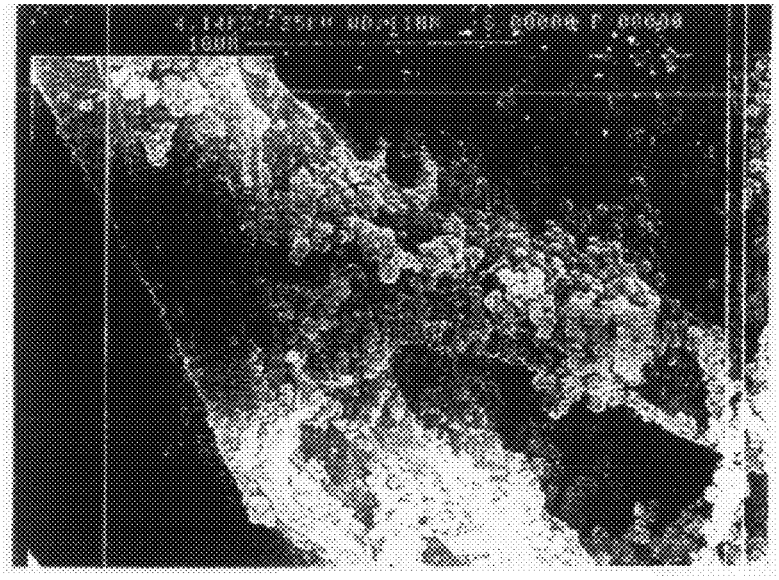
Figure 14:
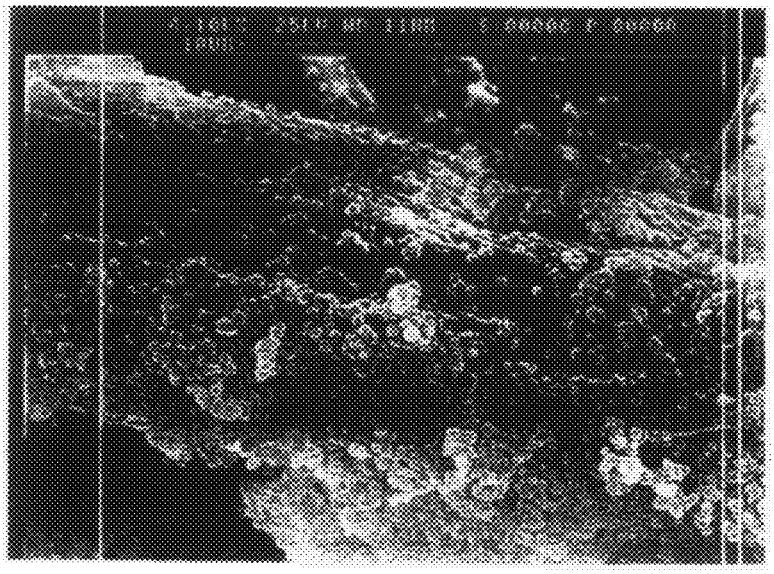
Figure 15:
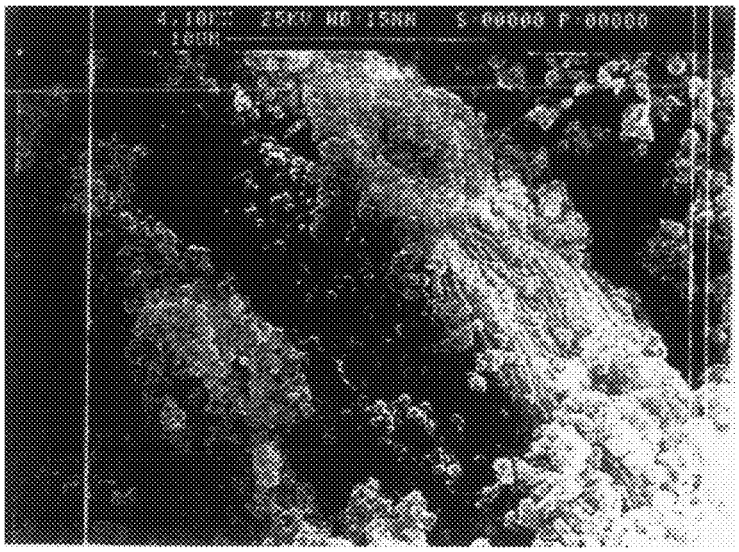
Figure 16:
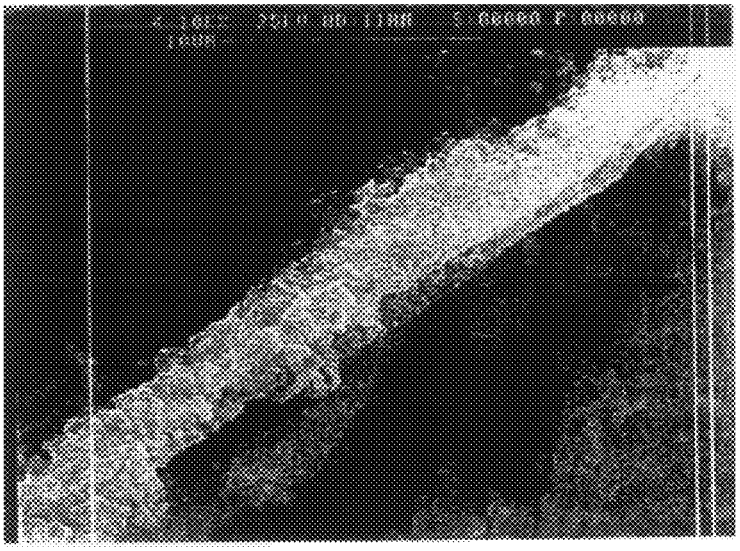
Figure 17:
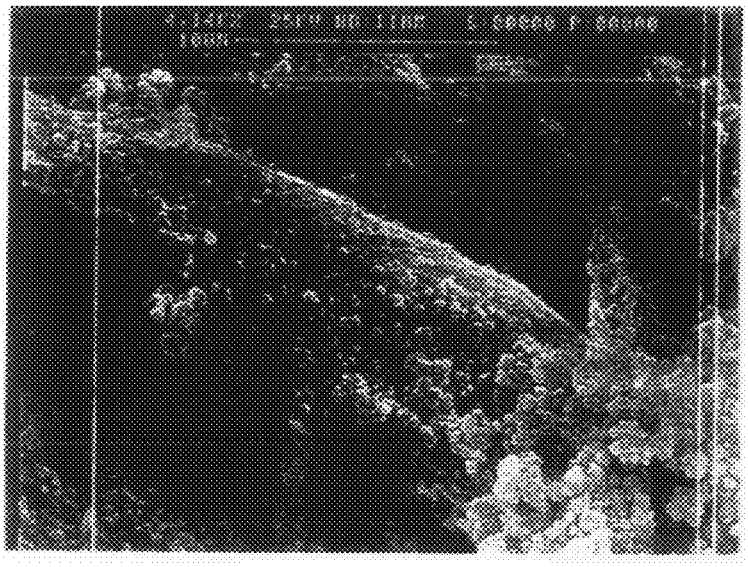
Figure 18:
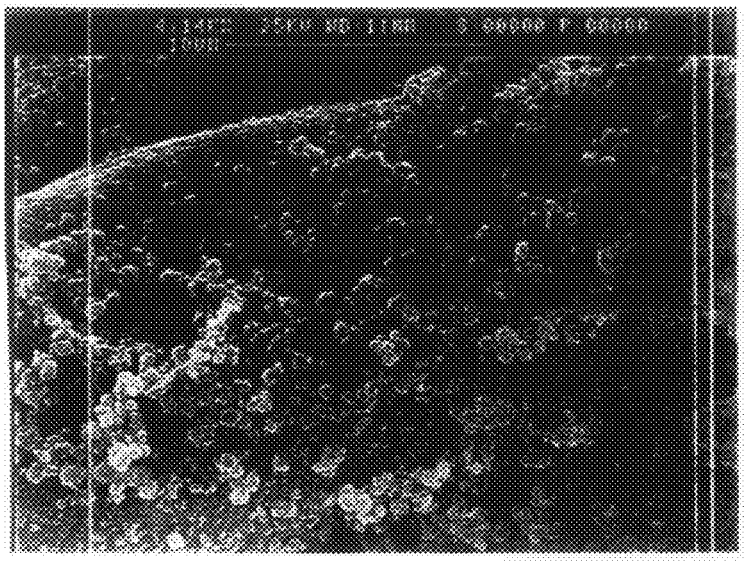
Figure 19:
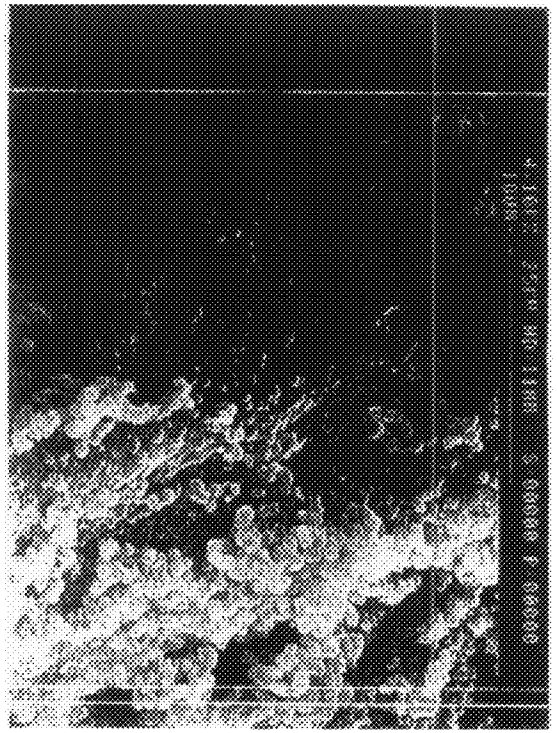
Figure 20:
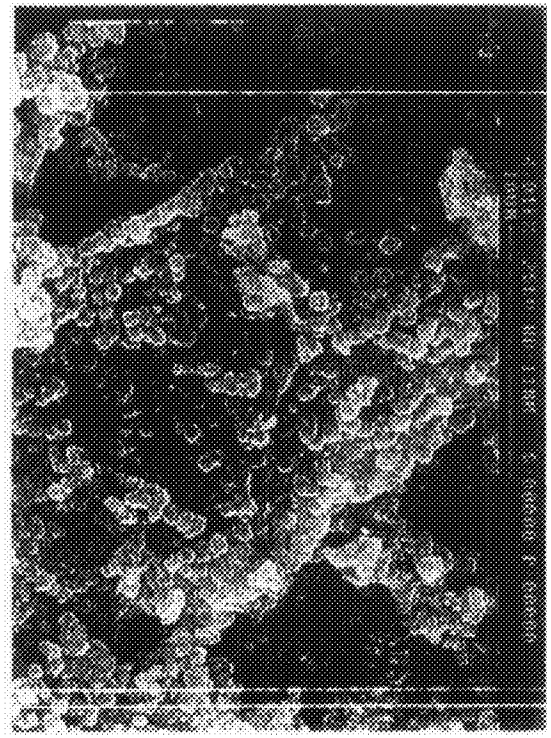
Figure 21:
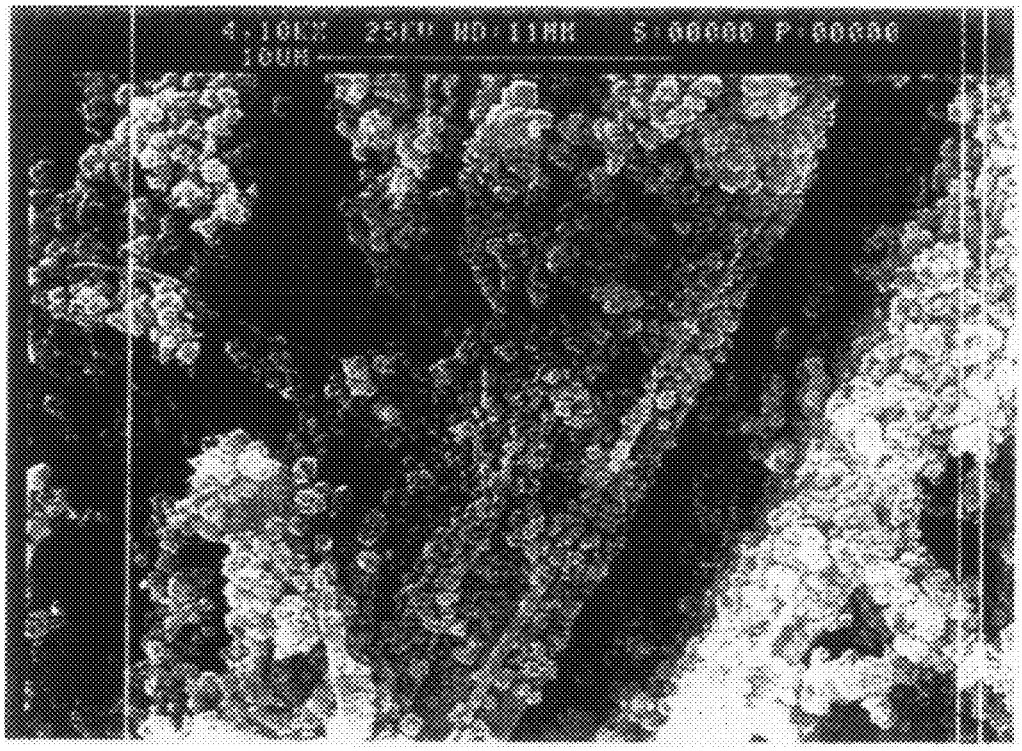

FIG. 11 to 21 show SEM views of paper pulps according to the invention obtained from different types and varieties of mechanical pulps, FIG. 11 is a view with a magnification of 4,050 times of a paper pulp according to the invention obtained with 30% of TEMCELL BIRCH BULK mechanical pulp at 24° SR and 70% of $CaCO_3$ obtained from ground slaked lime, FIG. 12 is a view with a magnification of 4,100 times of a paper pulp according to the invention obtained with 30% of TEMCELL 325/85 at 38° SR mechanical pulp and 70% of $CaCO_3$ obtained from ground slaked lime, FIG. 13 is a view with a magnification of 4,140 times of a paper pulp according to the invention obtained with 30% of TEMCELL 250/85 HW mechanical pulp at 43° SR and 70% of $CaCO_3$ obtained from ground slaked lime, FIG. 14 is a view with a magnification of 4,100 times of a paper pulp according to the invention obtained with 30% of MILLAR WESTERN 325-85-100 mechanical pulp at 38° SR and 70% of $CaCO_3$ obtained from ground slaked lime, FIG. 15 is a view with a magnification of 4,100 times of a paper pulp according to the invention obtained with 30% of ROTTNEROS CA 783 mechanical pulp at 32° SR and 70% of $CaCO_3$ obtained from ground slaked lime, FIG. 16 is a view with a magnification of 4,100 times of a paper pulp according to the invention obtained with 30% of SODRA 100/80 mechanical pulp at 70° SR and 70% of $CaCO_3$ obtained from ground slaked lime, FIG. 17 is a view with a magnification of 4,140 times of a paper pulp according to the invention obtained with 30% of WAGGERYD CELL AB. C 150/78 mechanical pulp at 62° SR and 70% of $CaCO_3$ obtained from ground slaked lime, FIG. 18 is a view with a magnification of 4,140 times of a paper pulp according to the invention obtained with 30% of SCA (Ostrand) HT TISSUE 001 mechanical pulp at 24° SR and 70% of $CaCO_3$ obtained from ground slaked lime, FIG. 19 is a view with a magnification of 4,100 times of a paper pulp according to the invention obtained with 30% of ZUBIALDE PX3 mechanical pulp at 58° SR and 70% of $CaCO_3$ obtained from ground slaked lime, FIG. 20 is a view with a magnification of 4,010 times of a paper pulp according to the invention obtained with 30% of M-REAL SPHINX 500/80 mechanical pulp at 25° SR and 70% of $CaCO_3$ obtained from ground slaked lime, FIG. 21 is a view with a magnification of 4,100 times of a paper pulp according to the invention obtained with 30% of RONDCHATEL 8255 mechanical pulp at 52° SR and 70% of $CaCO_3$ obtained from ground slaked lime, The initial pulps used in the process according to this invention are mechanical pulps obtained from different woods, for example softwood or hardwood or eucalyptus. A chemical treatment can accompany the mechanical treatment; for example CTMP type pulps may also be used as the initial product.

As a result of the mechanical process according to which they are obtained, all mechanical pulps used have an SR degree of more than 22°. Cellulose fibres contained in these pulps also have some degree of fibrillation.

This invention uses the reference technique for measuring the SR value described in ISO standard 5267-1, this method can be used to determine the drainage characteristics of an aqueous slurry of pulp as a function of its SR degree.

These pulps are firstly bleached according to conventional techniques well known to an expert in the subject, for example using oxygenated water, and steps a), b) and c) of the process according to the invention are then used.

Step a) consists of forming a homogenous aqueous slurry by putting the previously bleached initial mechanical pulp into the presence of lime in an aqueous medium.

Therefore lime or calcium hydroxide is the source of calcium ions $Ca^{2+}$. Quick lime or lime already in the form of an aqueous slurry (slaked) may be used. The paper pulp and the lime may be introduced directly in the form of a slurry, into an appropriate vat type reactor. A pulp in the form of an aqueous slurry containing 0.1 to 10% by weight of dry material may for example be added, and then an aqueous slurry of lime containing 0.1 to 30%, and preferably 13% by weight of dry material, is added while stirring moderately. Moderate stirring means for example stirring at a speed of the order of 1 to 30 rpm.

According to one preferred embodiment of the invention that further improves the resistance to yellowing under light and therefore the whiteness of bleached mechanical paper pulps according to the invention, the lime used is in the form of particles with an average diameter of less than 9 μm, and preferably equal to 5 μm. For example, this particle size can be obtained by using slaked lime previously subjected to wet grinding in a micro-ball grinder, like that marketed by the WAB AG Company (Basel) under the name DYNO®-Mill KD type. The average diameter of lime particles is measured using a laser size grader type 230 made by the COULTER Company.

The slurry then has to have a dry material content less than 10% by weight and preferably less than 5% and preferably equal to 2.5%, so that the calcium carbonate crystallises under good conditions. The dry material content determines the viscosity of the slurry. The viscosity must not be too high, in order to guarantee that the reaction is homogenous. Thus the dilution step b) consists of adjusting the slurry prepared in step a), if its dry material content is too high, so that it has the required dry material content (namely less than 10%) corresponding to the required viscosity.

It is preferable that the slurry formed of paper pulp and lime should not be stored for more than 30 minutes to prevent the lignin present in and on the fibres from reacting with lime which would cause yellowing of the pulp. Thus, steps a) and b) of the process preferably last for less than 30 minutes.

Step c) then consists of adding carbon dioxide gas by injection into this diluted slurry at a stable temperature of between 10 and 50° C., while mixing the slurry and keeping the temperature of the slurry between 10 and 50° C., until all the lime has been fully transformed into calcium carbonate that crystallises in situ.

Therefore, carbon dioxide ($CO_2$) forms the source of carbonate ions $CO_3^{2-}$. This carbon dioxide is injected into the slurry, for example, at a flow of the order of 0.1 to 30 $m^3$/h/kg of calcium hydroxide and preferably 15 $m^3$/h/kg. When carbon dioxide is added, the reacting mix is stirred strongly, for example at between 100 and 3000 rpm and preferably at 500 rpm.

The reaction is terminated when all lime initially present has reacted, which results in reducing the pH of the slurry which was initially basic and therefore close to 12, to a neutral pH, that stabilises at about 7 at the end of the reaction.

As already described, crystallisation of calcium carbonate on cellulose, hemicelluloses and lignin fibres may take place in a vat type reactor using a discontinuous process. A continuous process can also be used in which the different reagents used are injected and mixed one after the other in a tube type reactor provided with static mixers. In this case, the initial pulp is sent to a tubular reactor, and the aqueous slurry of lime is then injected followed by $CO_2$ injected at one or several points. Next to each injection point, the tubular reactor is provided with an appropriate number and type of static mixers to make the mix uniform so that the reaction can take place uniformly and the calcium carbonate can crystallise uniformly distributed on the cellulose, hemicelluloses and lignin fibres.

The tubular reactor must be long enough so that the reaction is terminated at the exit from the reactor. This length depends on product concentrations and flows used.

Industrially, this type of continuous process has a number of advantages; no intermediate storage tank is necessary, the flow may be regulated to adapt it to the output consumption; lime and $CO_2$ injections may be stopped immediately if a problem occurs at the outlet from the reactor, and thus there is no need to store an intermediate product.

A hybrid continuous/discontinuous process can also be used. In this case, the initial pulp and lime are then added in sequence while stirring into a vat. The slurry obtained is then sent into a tubular reactor in which $CO_2$ is injected at one or several points. The tubular reactor is provided with an appropriate number of static mixers to ensure that the mix is uniform. Once again, the tubular reactor must be long enough so that the reaction is terminated at the exit from the reactor.

Patent FR 92 04 474 describes a process for making complex new products, intended particularly for construction materials, papermaking products, unwoven opacified substrates using steps similar to steps a), b) and c) in the process according to the said invention. The technical problem that the process described in FR 92 04 474 tends to solve, is to provide a product with an improved resistance and/or cohesion under the mechanical stresses applied to it. Surprisingly, the applicant has demonstrated that application of a process of this type to previously bleached, mechanical pulps composed of cellulose, hemicelluloses and lignin can improve the stability of the paper pulps obtained under light, by reducing their yellowing.

According to the process described in this invention, calcium carbonate crystallises mostly in the form of clusters of grains covering the cellulose, hemicelluloses and lignin fibres, with non-labile mechanical bonding with good distribution and a preferred concentration on the areas with the highest specific area. Thus, pulps according to the invention have a particular structure; the calcium carbonate crystals are distributed and mechanically grafted onto the fibrillated fibres which are thus covered as illustrated in FIGS. 2 to 7 and 11 to 21. These FIGS. 1 to 7 and 11 to 21 are photos taken using a scanning electronic microscope SEM with a Stereoscan 90 type instrument made by Cambridge Instruments, on paper pulps according to the invention that had previously been dried using a critical point technique described in patent FR 92 04 474.

FIGS. 2 to 7 and 11 to 21 show that in the examples chosen, the carbonate crystallises in cubic form. Operating conditions may be modified to obtain rhombohedric or scalenohedric shaped crystals.

Pulps according to this invention preferably comprise more than 20% by weight, and preferably more than 50% by weight of calcium carbonate compared with the total dry material. For example, these pulps may contain 20 to 75% by weight of calcium carbonate, 80 to 25% by weight of cellulose, hemicelluloses and lignin, with respect to the total dry material.

Other agents such as blueing agents may also be included in the bleached mechanical paper pulps according to the invention.

Another purpose of this invention is paper fabricated from paper pulp according to the invention. These papers are prepared using conventional papermaking techniques well known to an expert in the subject. Paper pulps according to the invention are generally mixed with other pulps for making paper, to obtain a maximum content of calcium carbonate equal for example to approximately 10 to 40% by weight compared with the total dry material.

The following EXAMPLES illustrate the invention without limiting it and demonstrate that papers obtained with mechanical paper pulps bleached according to the invention are more stable in terms of yellowing under light.

FIRST SERIES OF EXAMPLES

These examples were made using filtered slaked lime or ground slaked lime, in the form of particles with an average diameter of 5 μm.

A dispersion of slaked lime containing 25% of dry material (LYS-Polienas slaked lime extra white grade by BALTHAZARD and COTTE) and 1% of Coatex GSN (by COATEX) as the dispersing agent is diluted to obtain a dry material content of 13%, and is then filtered on a 100 μm sieve. This lime is either used directly (unground lime) or is ground in a DYNO®-Mill microball mill of the KLD-Pilot type to obtain particles with an average diameter equal to 5 μm.

Reactions are carried out in a 52 m long 10 mm diameter tubular reactor with two static mixers, using the following parameters:

Percentage of slaked lime/BCTMP=Sufficient quantities to obtain $CaCO_3$/BCTMP ratios of 70/30, 50/50 or 30/70, % of dry material before injection of $CO_2$: 2.5%, Reaction pressure: 4 bars, $CO_2$ pressure: 6 bars, Reaction rate: 2l/min, Reaction temperature: 25° C., $CO_2$ flow: 6l/min, pH at exit from reactor: 6.4.

BCTMP pulp (reference R250B85 (Poplar) made by the Ranger Slave Lake Pulp Corporation Company (Canada)) is used either as sold at 38° SR, or is used refined to 52° SR.

The various pulps presented in TABLE 1 are prepared:

TABLE 1

| BCTMP | | | $CaCO_3$ | |
|---|---|---|---|---|
| EXAMPLE | ° SR | % | ground | % |
| 1 | 38 | 30 | no | 70 |
| 2 | 52 | 30 | no | 70 |
| 3 | 38 | 30 | yes | 70 |
| 4 | 52 | 30 | yes | 70 |
| 5 | 38 | 50 | yes | 50 |
| 6 | 38 | 70 | yes | 30 |

FIG. 2 to 7 show SEM views of the pulps for EXAMPLES 1 to 6 respectively.

Paper sheets were made using paper pulps according to EXAMPLES 1 to 4 above.

The target calcium carbonate content in each sheet of paper is 20%, the calcium carbonate being brought in exclusively through pulps according to the invention, the content of BCTMP consequently being 8.6% of the total (namely about 10.75% of the pulps).

A mix of 80% of CELIMO hardwood pulp and 20% of CELIMO softwood pulp refined to 25° SR is added to form the sheet of paper. The grammage of the sheets is 78 to 80 $g/m^2$.

An accelerated aging test is carried out on these sheets of paper. Aging under light and under ambient conditions is a relatively slow process and an accelerated test has to be used to evaluate the stability of a pulp or paper to light. It is recognised that artificial aging can be used to evaluate the stability of a group of papers and to classify them with respect to each other (Nordic Pulp and Paper Research Journal, 1998, 13(3), 191-197). A SUNTEST table instrument made by Original HANAU is used to study the accelerated aging of papers according to the invention.

Two control pulps are made: T1 containing 30% of BCTMP at 38° SR and 70% of precipitated calcium carbonate marketed under the name Mégafill® (Speciality Minerals France) and T2 comprising 30% of BCTMP at 52° SR and 70% of Mégafill®. Sheets of paper are made from control pulps T1 and T2 under the same conditions as described above with pulps 1 to 4. The precipitated calcium carbonate and BCTMP are in exactly the same quantities for T1 and for EXAMPLES 1 and 3 and for T2 and EXAMPLES 2 and 4, the only significant difference being that in one case (Controls T1 and T2), the precipitated calcium carbonate is distributed at random throughout the entire sheet, and in the other case (the subject of this invention), it is crystallised on BCTMP pulp fibres.

TABLE 2 below shows the loss of CIE whiteness (the CIE whiteness is defined according to international standard ISO 11475) obtained after 60 minutes and 180 minutes of exposure to the SUNTEST, with paper sheets made using control pulps T1 and T2 and the pulps in EXAMPLES 1 to 4.

TABLE 2

| | PAPER PULP USED | | | | | |
|---|---|---|---|---|---|---|
| | T1 | 1 | 3 | T2 | 2 | 4 |
| Δ CIE 60 minutes | 13.4 | 8.68 | 9.99 | 13.05 | 8.79 | 10.03 |
| Δ CIE 180 minutes | 19.95 | 12.67 | 15.92 | 18.98 | 12.91 | 14.97 |

FIG. 8 shows the variation of the CIE whiteness as a function of the exposure time (t) to the SUNTEST in minutes for papers obtained with pulps 1 to 4 and T1 and T2. These results show that papers according to the invention have a lower loss of whiteness than the control, equal to about 3 to 8 CIE points after 60 minutes and 4 to 7.5 CIE points after 180 minutes.

FIG. 9 shows the variation of the CIE whiteness as a function of the exposure time (t) to the SUNTEST in minutes for papers obtained with pulps 1 and 2 (filtered lime) and 3 and 4 (ground lime). These results show the effect of ground lime on the whiteness of the paper obtained. The initial gain in whiteness is about 10 CIE points, which is a significant improvement.

In the following example, the light resistance performances of pulps 3, 5 and 6 are compared with each other. This is done by preparing paper sheets containing 80% by weight of pulps 3, 5 or 6 and 20% of a mix of Celimo hardwood and softwood pulps (ratio 80/20) refined to 25° SR. These sheets are subjected to the accelerated aging test as above using the SUNTEST table instrument made by Original HANAU.

TABLE 3 below shows the loss of CIE whiteness obtained after 60 minutes of exposure to the SUNTEST, using paper sheets made using pulps 3, 5 and 6.

TABLE 3

| | PAPER PULP USED | | |
|---|---|---|---|
| | 3 | 5 | 6 |
| Δ CIE 60 minutes | 12.4 | 15.0 | 19.5 |

Therefore, we can see that as the content of $CaCO_3$ precipitated on the BCTMP increases, the loss of CIE whiteness during irradiation in the SUNTEST decreases, the $CaCO_3$ precipitated on the fibres performing a protective role preventing yellowing of the lignin.

The influence of the content of $CaCO_3$ precipitated on the BCTMP is demonstrated in FIG. 10 that shows the variation of the CIE whiteness as a function of the exposure time (t) to the SUNTEST in minutes for papers obtained with pulps 3, 5 and 6.

SECOND SERIES OF EXAMPLES

In the following examples, different mechanical pulps were used as the initial product for the calcium carbonate precipitation reaction. Reaction conditions are similar to those described above, in other words: a dispersion of slaked lime containing 25% of dry material (LYS-Polienas slaked lime extra white grade by BALTHAZARD and COTTE) and 1% of Coatex GSN (by COATEX) as the dispersing agent is diluted to obtain a dry material content of 13%, and is then filtered on a 100 μm sieve. This lime is ground in a DYNO®-Mill microball mill of the KLD-Pilot type to obtain particles with an average diameter equal to 5 μm.

Reactions are carried out in a 52 m long 10 mm diameter tubular reactor with two static mixers, using the following parameters:

Percentage of slaked lime/BCTMP=Sufficient quantities to obtain $CaCO_3$/BCTMP ratios of 70/30, % of dry material before injection of $CO_2$: 2.5%, Reaction pressure: 4 bars, $CO_2$ pressure: 6 bars, Reaction rate: 2l/min, Reaction temperature: 25° C., $CO_2$ flow: 6l/min, pH at exit from reactor: 6.4.

The initial pulps used and their characteristics are summarised in TABLE 4 below.

TABLE 4

| MECHANICAL PULP | | | | | | $CaCO_3$ | |
|---|---|---|---|---|---|---|---|
| EXAMPLE | PULP REFERENCE | SUPPLIER | VARIETY | ° SR | % | Ground | % |
| 7 | Temcell Birch Bulk | TEMBEC | Birch | 24 | 30 | Yes | 70 |
| 8 | Temcell 325/85 | TEMBEC | Hardwood | 38 | 30 | Yes | 70 |
| 9 | Temcell 250/85 HW | TEMBEC | Hardwood | 43 | 30 | Yes | 70 |
| 10 | 325-85-100 | MILLAR WESTERN | Hardwood | 38 | 30 | Yes | 70 |
| 11 | CA 783 | ROTTNEROS AB | Hardwood | 32 | 30 | Yes | 70 |
| 12 | 100/80 | SÖDRA | Spruce | 70 | 30 | Yes | 70 |
| 13 | Cell AB.C 150/78 | WAGGERYD AB | Softwood | 62 | 30 | Yes | 70 |
| 14 | HT Tissue 001 | SCA (Ostrand) AB | Softwood | 24 | 30 | Yes | 70 |
| 15 | PX3 | ZUBIALDE | Pine Radiata | 58 | 30 | Yes | 70 |
| 16 | Sphinx 500/80 | M-REAL | Spruce | 25 | 30 | Yes | 70 |
| 17 | 8255 | RONDCHATEL | Spruce | 52 | 30 | Yes | 70 |

FIG. 11 to 21 show SEM photos of paper pulps according to EXAMPLES 7 to 17, respectively.

Pulps 7 to 17 are used to make paper sheets containing 80% by weight of pulp 7 to 17 and 20% of a mix of CELIMO hardwood and softwood pulps (ratio 80/20) refined to 25° SR.

For each case, a corresponding control sheet is made containing the same type and the same quantity of mechanical pulp, the same quantity of a mix of CELIMO hardwood and softwood pulps (ratio 80/20) refined to 25° SR and precipitated calcium carbonate marketed under the name Mégafill® (Speciality Minerals France) in a quantity equivalent to the quantity present in paper sheets made with pulps according to the invention. In the case of control sheets, the precipitated calcium carbonate is randomly distributed throughout the sheet, while for sheets according to this invention, it is crystallised on mechanical pulp fibres.

As above, these sheets are subjected to the accelerated aging test using the SUNTEST table instrument made by Original HANAU.

TABLE 5 below shows the loss of CIE whiteness obtained after 60 minutes exposure to the SUNTEST, for sheets of paper made using pulps 7 to 17 and their corresponding controls.

TABLE 5

| PULP USED | Δ CIE whiteness - 60 min |
|---|---|
| EXAMPLE 7 | 13.5 |
| EXAMPLE 7 control | 18.3 |
| EXAMPLE 8 | 11.1 |
| EXAMPLE 8 control | 14.9 |
| EXAMPLE 9 | 12.6 |
| EXAMPLE 9 control | 14.8 |
| EXAMPLE 10 | 13.3 |
| EXAMPLE 10 control | 14.9 |
| EXAMPLE 11 | 10.0 |
| EXAMPLE 11 control | 12.3 |
| EXAMPLE 12 | 13.6 |
| EXAMPLE 12 control | 14.7 |
| EXAMPLE 13 | 12.4 |
| EXAMPLE 13 control | 13.6 |
| EXAMPLE 14 | 16.0 |
| EXAMPLE 14 control | 19.3 |
| EXAMPLE 15 | 14.2 |
| EXAMPLE 15 control | 17.1 |
| EXAMPLE 16 | 10.2 |
| EXAMPLE 16 control | 16.3 |
| EXAMPLE 17 | 7.8 |
| EXAMPLE 17 control | 11.2 |

These results show that papers made with pulps according to the invention have a lower loss of whiteness than the corresponding controls, regardless of the type of mechanical pulp used (different varieties of hardwood and softwood and different treatments). The $CaCO_3$ precipitated on fibres really plays a protective role against yellowing of lignin.

The invention claimed is:

1. A method of making bleached mechanical pulp, comprising mixing an aqueous medium comprising bleached mechanical pulp comprised of fibrillated fibers of cellulose, hemicelluloses and lignin with lime to form an aqueous slurry; and adding carbon dioxide to said slurry to form a bleached mechanical pulp comprising crystallized calcium carbonate mechanically bonded to and at least partially covering said fibers.

2. The method according to claim 1, wherein the slurry comprises less than 10% by weight of dry materials.

3. The method according to claim 1, further comprising diluting the slurry such that the slurry comprises 10% by weight of dry materials.

4. The method according to claim 3, wherein the mixing, diluting and adding steps are performed in a tube type reactor according to a continuous process.

5. The method according to claim 1, wherein the slurry comprises less than 5% by weight of dry materials.

6. The method according to claim 1, further comprising diluting the slurry such that the slurry comprises 5% by weight of dry materials.

7. The method according to claim 6, wherein the mixing, diluting and adding steps are performed in a tube type reactor according to a continuous process.

8. The method according to claim 1, wherein the aqueous medium of bleached mechanical pulp comprised of fibrillated fibers of cellulose has a Schopper Rieggler value equal to at least 22°.

9. The method according to claim 1, wherein the adding step is performed such that the carbon dioxide is injected into the slurry.

10. The method according to claim 1, wherein the adding step is performed at a temperature between 10 and 50° C.

11. The method according to claim 1, wherein the adding step is performed until transformation of the lime into crystallized calcium carbonate in situ is complete.

12. The method according to claim 1, wherein the crystallized calcium carbonate has an average diameter of less than 9 μm.

13. The method according to claim 1, wherein the crystallized calcium carbonate has an average diameter of from 5 μm to less than 9 μm.

14. The method according to claim 1, further comprising bleaching mechanical pulp prior to the mixing step.

15. The method according to claim 1, further comprising wet grinding the lime prior to the mixing step.

16. The method according to claim 1, wherein the mixing step is performed for less than 30 minutes.

17. The method according to claim 1, wherein the adding step is performed for less than 30 minutes.

18. The method according to claim 1, wherein the mixing and adding steps are performed in a tube type reactor according to a continuous process.

19. The method according to claim 1, wherein the bleached mechanical pulp is bleached chemithermomechanical pulp.

* * * * *